US007353944B1

(12) United States Patent
Herman

(10) Patent No.: US 7,353,944 B1
(45) Date of Patent: Apr. 8, 2008

(54) ROLL PACKAGE AND METHOD OF MAKING SAME

(76) Inventor: David J. Herman, 406 E. 4th St., Genoa, OH (US) 43430

( * ) Notice: Subject to any disclaimer, the term of this patent is extended or adjusted under 35 U.S.C. 154(b) by 544 days.

(21) Appl. No.: 10/902,430

(22) Filed: Jul. 29, 2004

Related U.S. Application Data

(60) Provisional application No. 60/491,354, filed on Jul. 31, 2003.

(51) Int. Cl.
*B65D 85/00* (2006.01)
*B65B 11/58* (2006.01)

(52) U.S. Cl. ..... 206/412; 206/410; 206/414; 53/449; 53/461; 53/587; 53/588

(58) Field of Classification Search ..... 206/389, 206/410, 412, 413, 414, 497; 229/87.01; 53/211, 399, 461, 587, 588, 372.9, 449, 176
See application file for complete search history.

(56) References Cited

U.S. PATENT DOCUMENTS 3,895,711 A * 7/1975 Hiltunen et al. ..... 206/413
4,475,651 A 10/1984 Elsner
4,565,051 A * 1/1986 Back ..... 53/441
4,860,893 A 8/1989 Kaufman
5,558,223 A 9/1996 Stefanescu
5,791,119 A 8/1998 Pienta
5,850,918 A 12/1998 Pienta
5,890,591 A 4/1999 Pienta
6,186,326 B1 2/2001 Pienta et al.
6,264,031 B1 * 7/2001 Pienta et al. ..... 206/410
6,446,804 B1 * 9/2002 Lehtineva ..... 206/410

* cited by examiner

*Primary Examiner*—J. Gregory Pickett
(74) *Attorney, Agent, or Firm*—MacMillan, Sobanski & Todd, LLC

(57) ABSTRACT

A roll package includes a material roll that is provided with the protective covering material. The material roll has an outer surface defining an axis. The protective covering material is axially wrapped about the material roll in a plurality of overlapping layers. An edge covering material is also circumferentially wrapped about the material roll. The edge covering material is radially interleaved/woven between the plurality of overlapping layers of the protective covering material. The roll package can be formed by simultaneously wrapping the material roll axially with the protective covering material while the material roll is rotated to circumferentially wrap the edge covering material thereabout.

12 Claims, 10 Drawing Sheets

ROLL PACKAGE AND METHOD OF MAKING SAME

CROSS-REFERENCE TO RELATED APPLICATIONS

This application claims the benefit of U.S. Provisional Application No. 60/491,354, filed Jul. 31, 2003, the disclosure of which is incorporated herein by reference.

BACKGROUND OF THE INVENTION

This invention relates in general to protective coverings for material rolls. More specifically, this invention relates to an improved structure for a roll package for such a material roll and to an improved method of manufacturing same.

Rolling long sheets of material into rolls is a well known method used for storing and shipping flexible sheet material products. Examples of some of the flexible sheet material products that are commonly provided in material rolls include a variety of paper products, film products, and textile products. In order to protectively cover the material roll during transportation and storage, it is desirable to provide the outer surface of the material roll with one or more layers of a protective covering material. In some instances, it is also desirable to protectively cover the ends of the material roll with one or more layers of a protective covering material. When a material roll is provided with the protective covering material, the combined structure is referred to as a roll package.

Roll packages can consist of multiple, independent layers of the protective covering material that are applied to the material roll. The layers of protective covering material can be applied either in an axial direction, a radial direction, or a combination of axial and radial applications. Where independent layers of the protective covering material are used, it has been found that the roll package is relatively expensive to produce, inasmuch as each layer of the protective covering material generally completely encases either the material roll itself or the previous layer of the protective covering material. Additionally, the individual layers of the protective covering material are relatively difficult to apply to the material roll, inasmuch as numerous affixing and cutting operations are required. Finally, the various independent layers of the protective covering material make it relatively difficult to remove the roll package from the material roll prior to use. Thus, it would be advantageous to develop an improved structure for a roll package and a method for manufacturing same that overcomes the above disadvantages.

SUMMARY OF THE INVENTION

This invention relates to an improved structure for a roll package for a material roll and to an improved method of manufacturing same. The roll package includes a material roll that is provided with the protective covering material. The material roll has an outer surface defining an axis. The protective covering material is axially wrapped about the material roll in a plurality of overlapping layers. An edge covering material is also circumferentially wrapped about the material roll. The edge covering material is radially interleaved/woven between the plurality of overlapping layers of the protective covering material. The roll package can be formed by simultaneously wrapping the material roll axially with the protective covering material while the material roll is rotated to circumferentially wrap the edge covering material thereabout.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
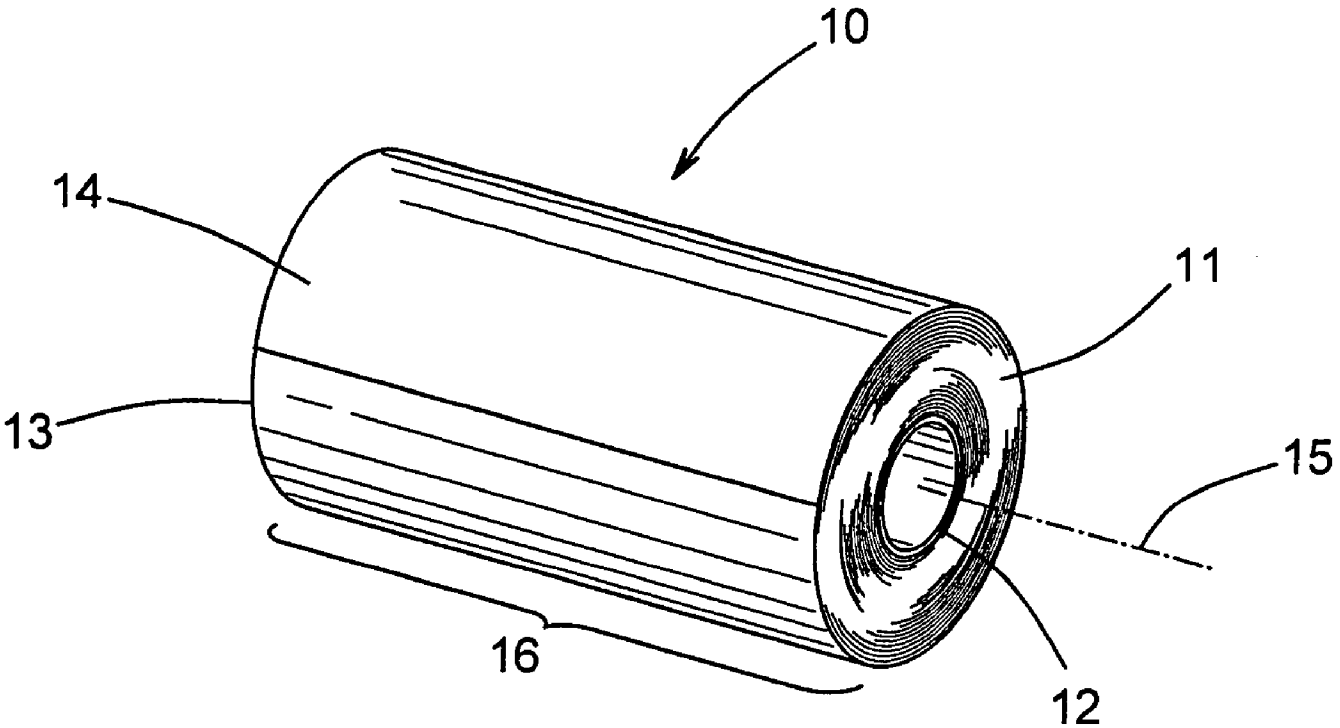
FIG. 1 (PRIOR ART)
FIG. 1 is a perspective view of a material roll that can be wrapped with a protective covering material to form a roll package in accordance with the invention.

Referring now to the drawings, there is illustrated in FIG. 1 a material roll, indicated generally at 10, that can be protectively covered in accordance with this invention to form a roll package. The illustrated material roll 10 can, for example, be formed by rolling one or more sheets of flexible sheet material into a roll. However, the illustrated material roll 10 is intended to be representative of any article, whether formed from a roll of flexible material or otherwise, that can be protectively covered in accordance with this invention.

The illustrated material roll 10 includes a core 12 that can be formed from any suitable material, such as cardboard or plastic, and may be any suitable size and shape. Preferably, the core 12 is equal in length to the width of a sheet of material 14 rolled thereabout, although such is not required. As the sheet of material 14 is rolled about the core 12, the resultant material roll 10 will generally follow the cross sectional shape of the core 12. Preferably, the core 12 and subsequent material roll 10 are generally cylindrical in shape, although it will be appreciated that the core 12 and material roll 10 may be of any suitable shape as well. The resultant material roll 10 has a longitudinal center axis 15 and a longitudinally extending outer surface 16 defined by two end surfaces 11 and 13 that are spaced apart by the width of the material sheet 14.

Figure 2:
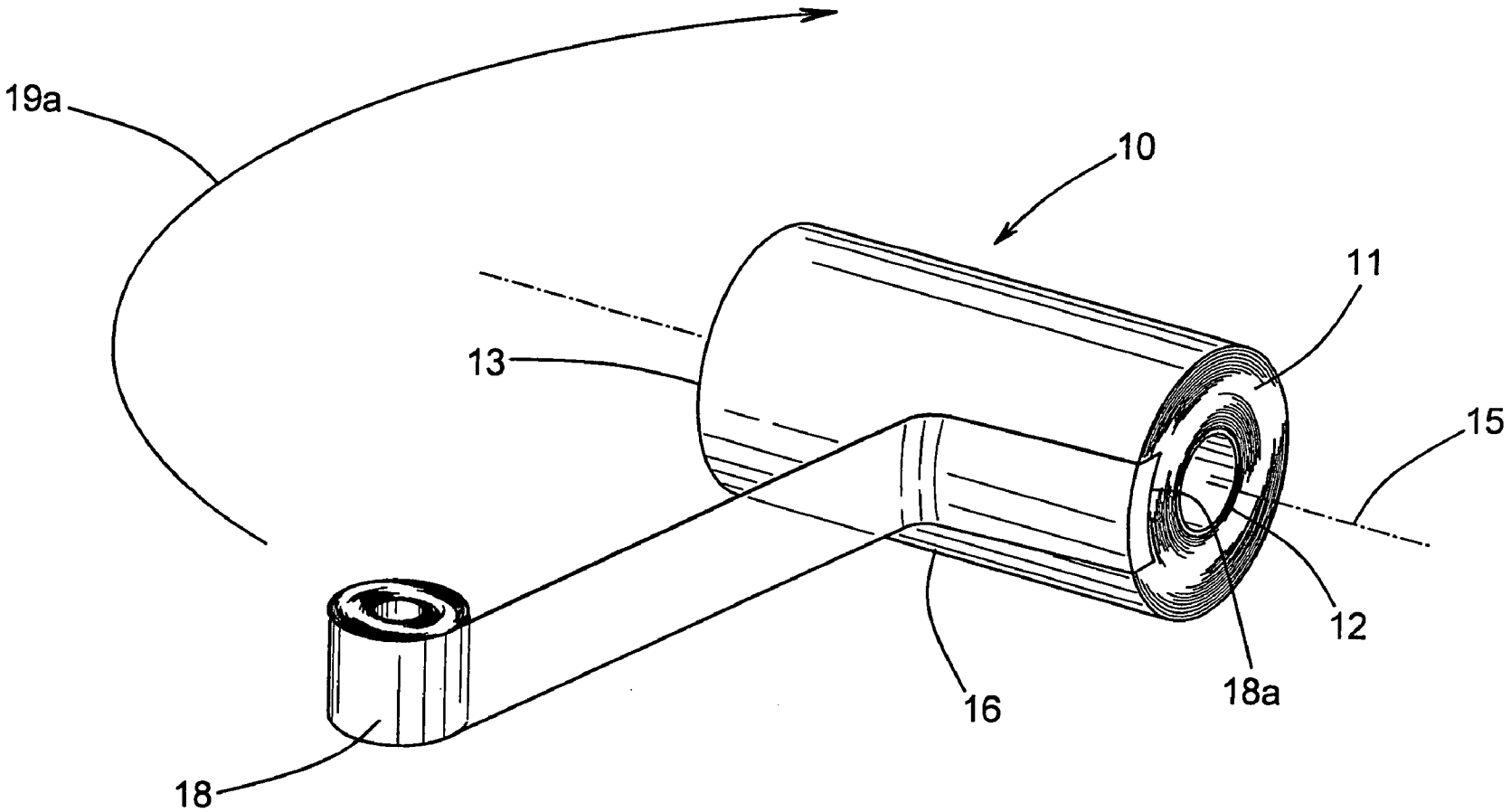
FIG. 2 is a perspective view showing a first step of a method of applying a protective covering material to the material roll illustrated in FIG. 1 in accordance with this invention.
Figure 3:
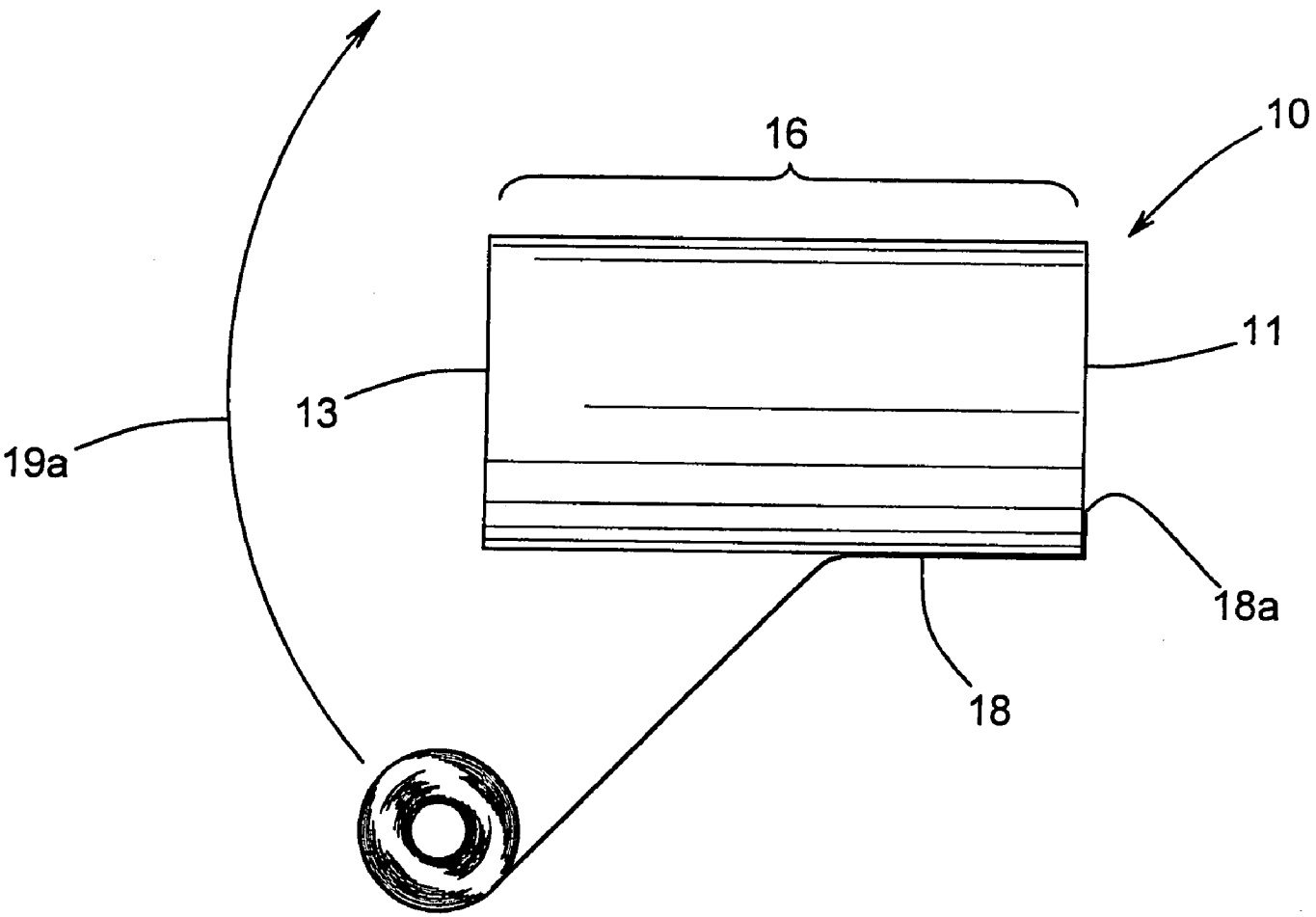
FIG. 3 is a top plan view showing the first step of the method illustrated in FIG. 2.

To form the roll package of this invention, a sheet of protective covering material 18 is wrapped about the material roll 10. The protective covering material 18 is preferably formed from an elongated sheet of plastic film material, such as polyethylene film. It will be appreciated, however, that the protective covering material 18 can be formed from any suitable material for providing a protective cover for the material roll 10. As shown in FIGS. 2 and 3, a leading edge 18*a* of the protective covering material 18 is initially applied to the material roll 10. This leading edge 18*a* of the protective covering material 18 can be applied at any location along the outer surface 16 or spaced end surfaces 11 and 13 of the material roll 10. The leading edge 18*a* of the protective covering material 18 may be held in place at the desired location on the on the material roll 10 using any suitable attachment means, such as static electrical force between the material roll 10 and the protective covering material 18, adhesive material applied to either the material roll 10 or protective covering material 18, or fasteners. In a preferred embodiment, the leading edge 18*a* of the protective covering material 18 is attached to the end surface 11 of the material roll 10 using the static electrical force between the material roll 10 and the protective covering material 18.

After the leading edge 18*a* of the protective covering material 18 has been initially applied to and retained on the material roll 10, the protective covering material 18 is then wrapped axially about the material roll 10, as shown by the arrow 19*a* in FIGS. 2 and 3. This axial wrapping of the material roll 10 causes the protective covering material 18 to be initially applied to the outer surface 16 of the material roll 10 in a direction that is generally parallel to the longitudinal center axis 15 thereof, then to the first end surface 13 of the material roll 10 in a direction that is generally perpendicular to the longitudinal center axis 15 thereof. Thereafter, the protective covering material 18 is applied to the opposite outer surface 16 of the material roll 10 in a direction that is generally parallel to the longitudinal center axis 15 thereof, then to the second end surface 11 of the material roll 10 in a direction that is generally perpendicular to the longitudinal center axis 15 thereof.

Figure 4:
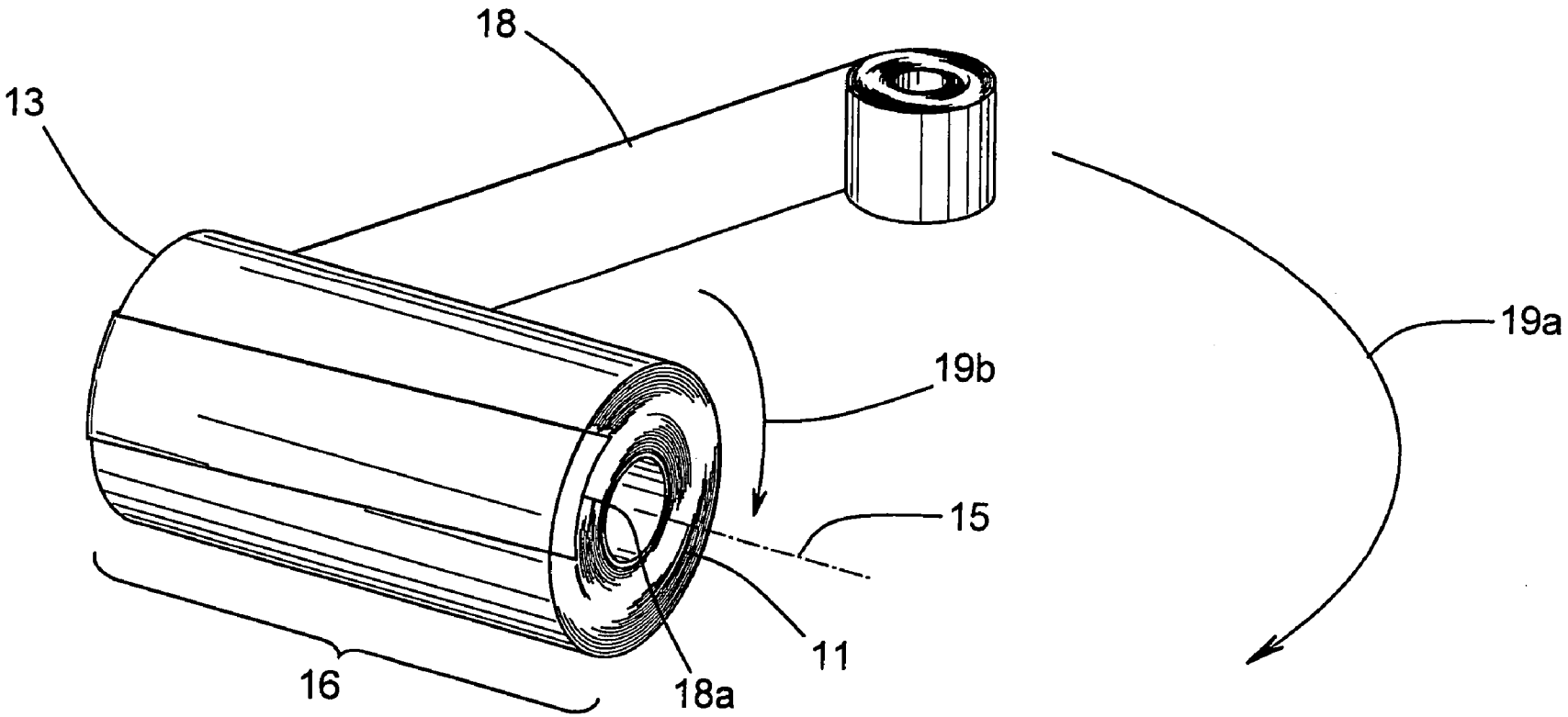
FIG. 4 is a perspective view showing a second step of the method of applying a protective covering material to the material roll.
Figure 5:
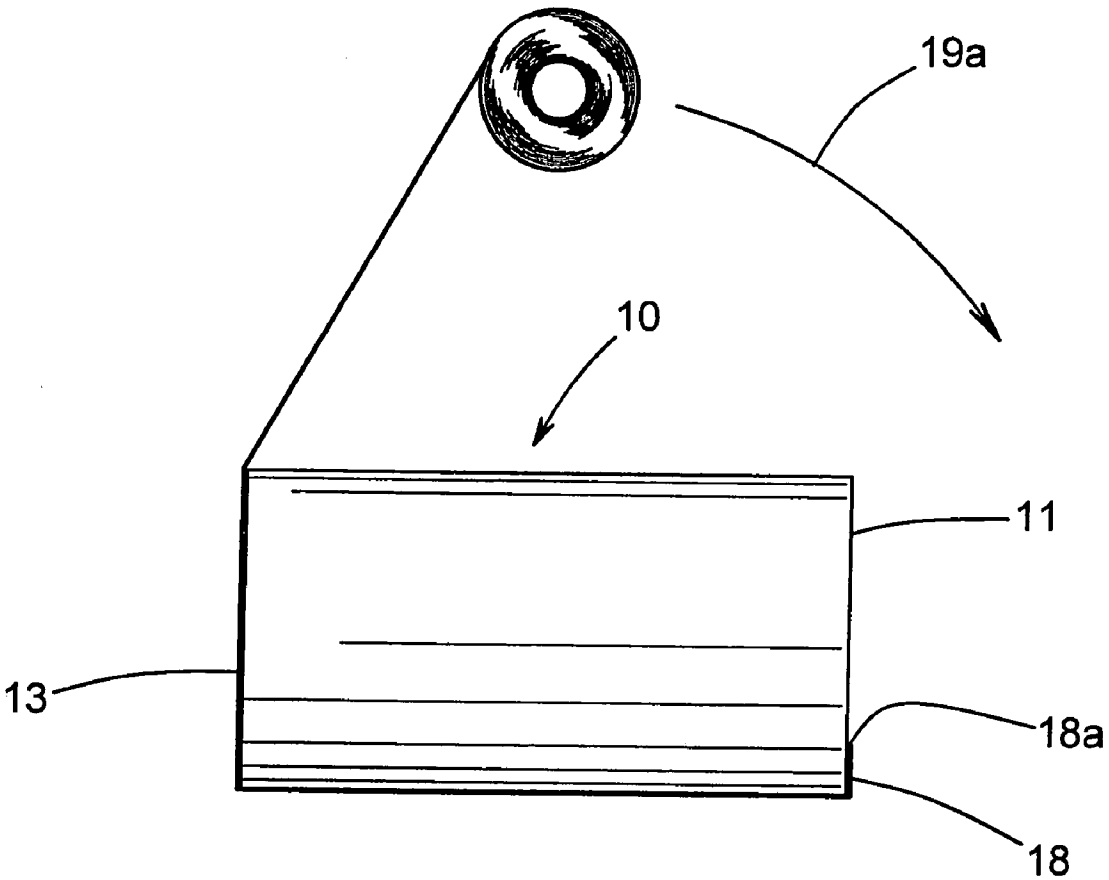
FIG. 5 is a top plan view showing the second step of the method illustrated in FIG. 4.

While this axial wrapping of the material roll 10 occurs, the material roll 10 is simultaneously rotated about its longitudinal center axis 15, as shown by the arrow 19*b* in FIG. 4. This simultaneous rotation of the material roll 10 during axial wrapping causes multiple intermediate layers of the protective covering material 18 to be applied in an overlapping manner to the outer surface 16 and end surfaces 11 and 13 of the material roll 10. The amount of overlap between the individual intermediate layers of the protective covering material 18 will vary depending upon the amount of protective coverage desired for the material roll 10. In a preferred embodiment, each subsequent intermediate layer of the protective covering material 18 that is applied to the outer surface 16 of the material roll 10 overlaps the previous layer of the protective covering material 18 by approximately forty percent of the surface area thereof. However, each subsequent intermediate layer of the protective covering material 18 can be applied to the outer surface 16 of the material roll 10 so as to overlap the previous layer of the protective covering material 18 by any desired amount.

Figure 6:
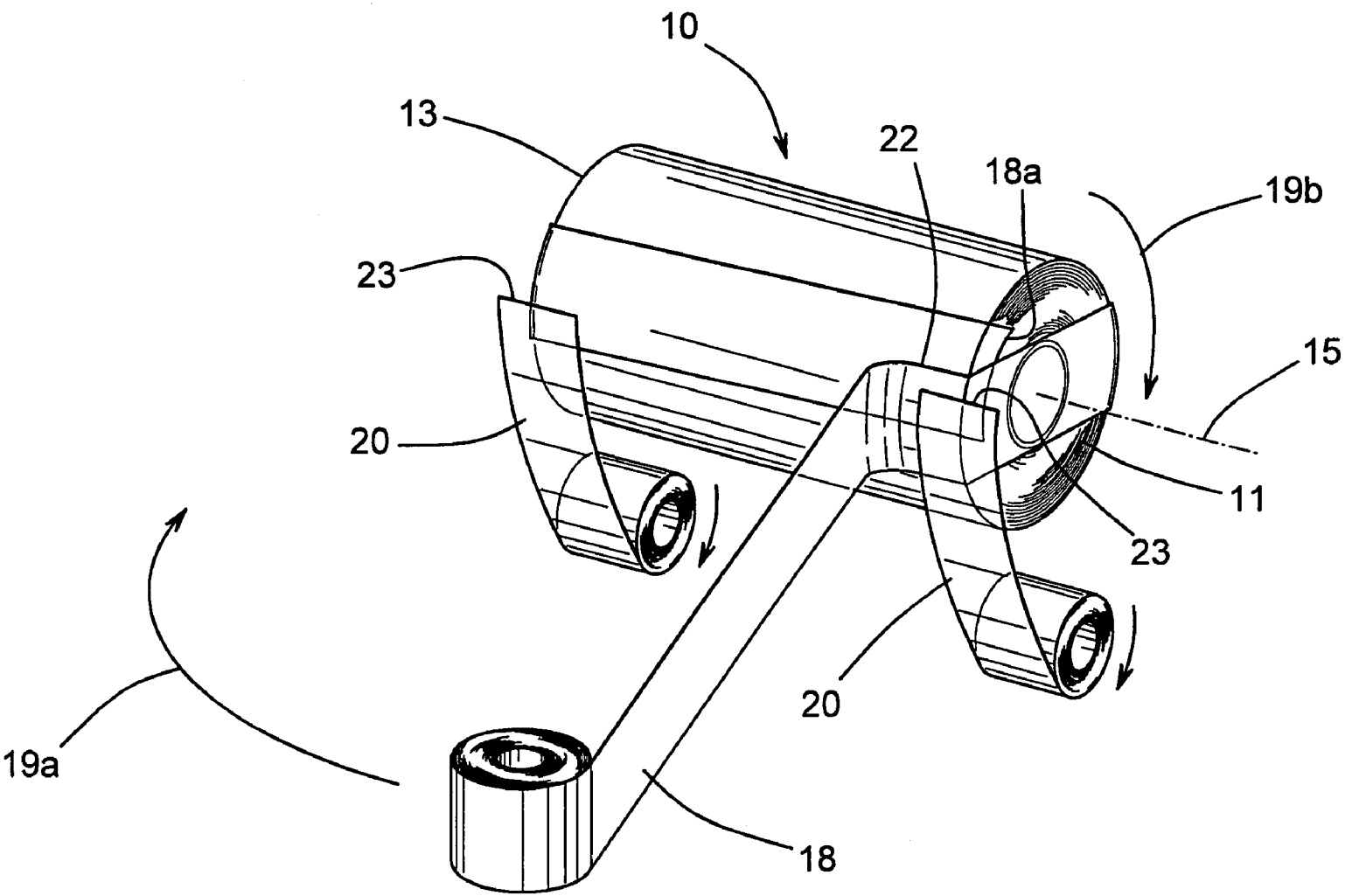
FIG. 6 is a perspective view showing a third step of the method of applying a protective covering material to the material roll.
Figure 7:
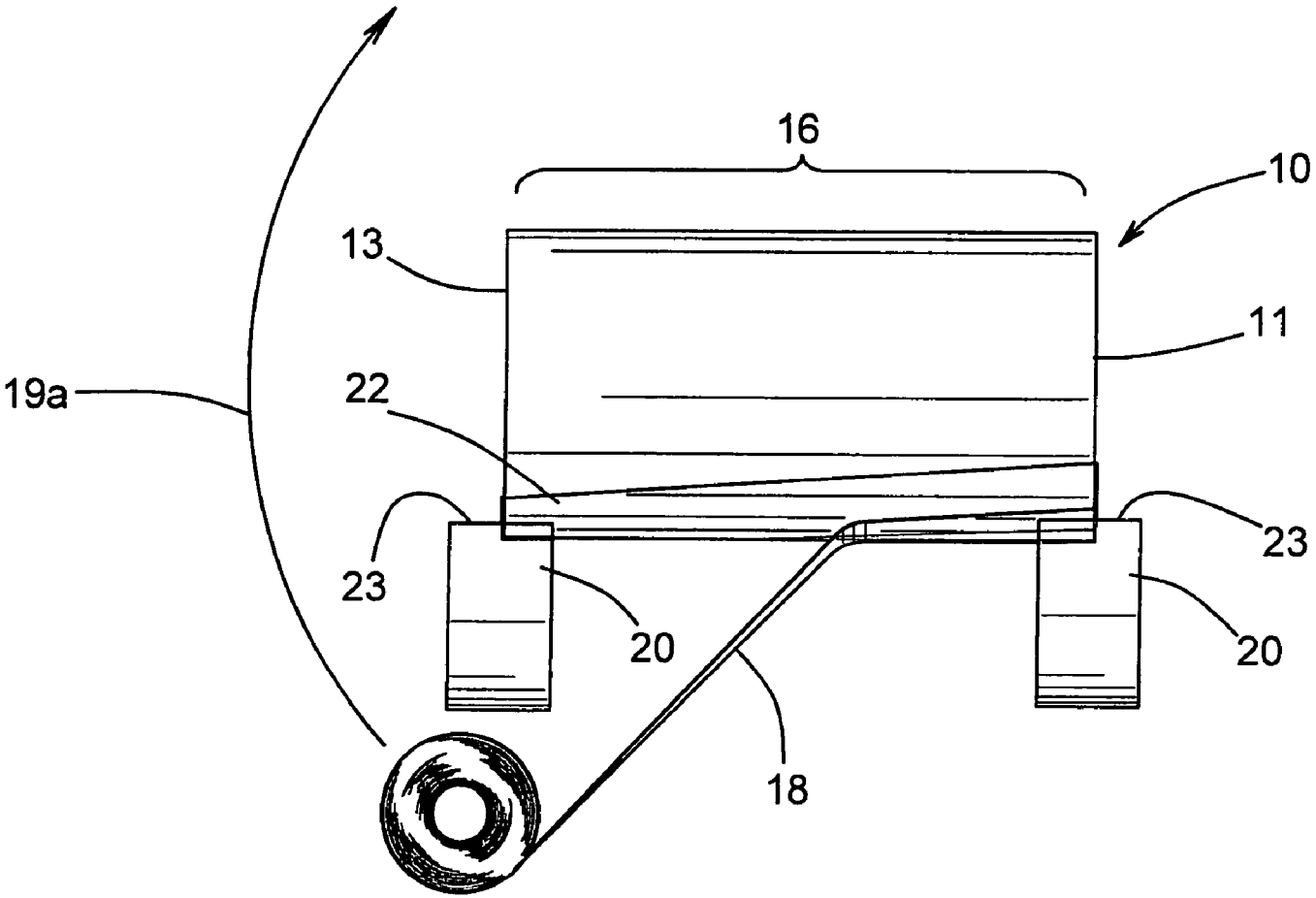
FIG. 7 is a top plan view showing the third step of the method illustrated in FIG. 6.

While the axial wrapping and rotation of the material roll 10 is occurring, an edge covering material 20 is simultaneously applied to either or both of the end surfaces 11 and 13 of the material roll 10, as shown in FIGS. 6 and 7. Preferably, this application of the edge covering materials 20 begins after a first or anchor layer 22 of the protective covering material 18 has been applied to the outer surface 16 and around the spaced end surfaces 11 and 13 of the material roll 10 (i.e., after one full axial wrap of the protective covering material 18 has been applied to the material roll 10). Each of the edge covering materials 20 may be formed from any suitable material that provides a protective barrier over the circular edge surfaces defined between the outer surface 16 and the spaced end surfaces 11 and 13 of the material roll 10. Examples of such suitable edge covering materials 20 include foam, cardboard, air cushioned plastic (bubble pack), or paper. A strip of the edge covering material 20 is preferably applied to each of such circular edge surfaces, although such is not required. Each of the strips of the edge covering material 20 can have any suitable width so as to cover predetermined portions of the outer surface 16 of the material roll 10 and predetermined portions of each of the spaced end surfaces 11 and 13.

Preferably, the width of each of the strips of the edge covering material 20 is less than the length of the outer surface 16 of the material roll 10, although such is not required. Leading edges 23 of the strips of the edge covering material 20 may be initially held in place on the anchor layer 22 using any suitable attachment means, such as by using an adhesive material that is applied to either the anchor layer 22 of the protective covering material 18 or to the leading edges 23 of the edge covering materials 20. Each of the edge covering materials 20 is positioned on the anchor layer 22 of the protective covering material 18 at or near the end of the outer surface 16 adjacent to the end surfaces 11 and 13 such that a first portion of the edge covering material 20 is located on the outer surface 16 of the material roll 10, while a second portion of the edge covering material 20 extends beyond the outer surface 16 of the material roll 10. As will be explained below, the second portions of the edge covering material 20 are provided to cover portions of the end surfaces 11 and 13 of the material roll 10 as the roll package is continued to be formed.

Figure 8:
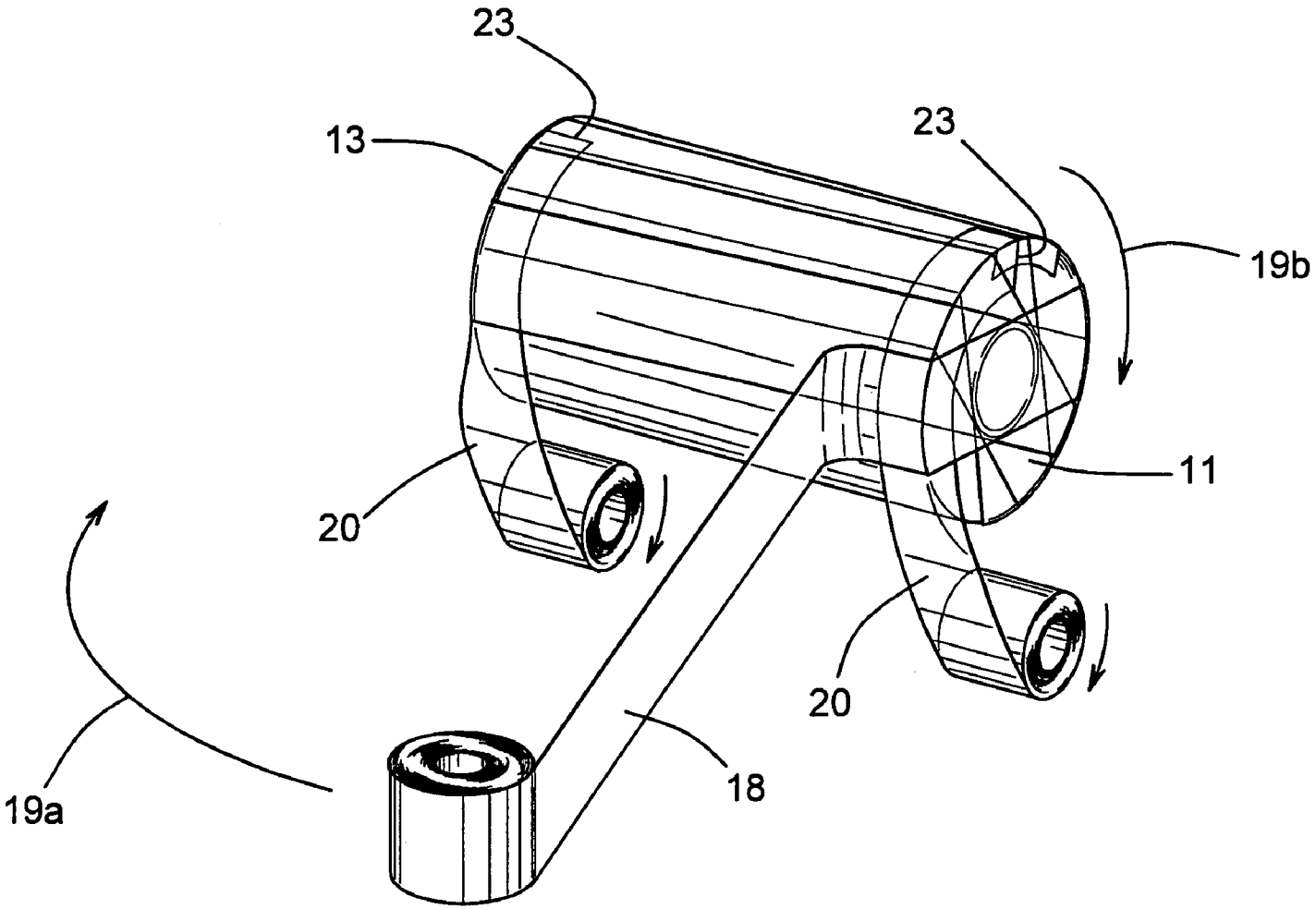
FIG. 8 is a perspective view showing a fourth step of the method of applying a protective covering material to the material roll.
Figure 9:
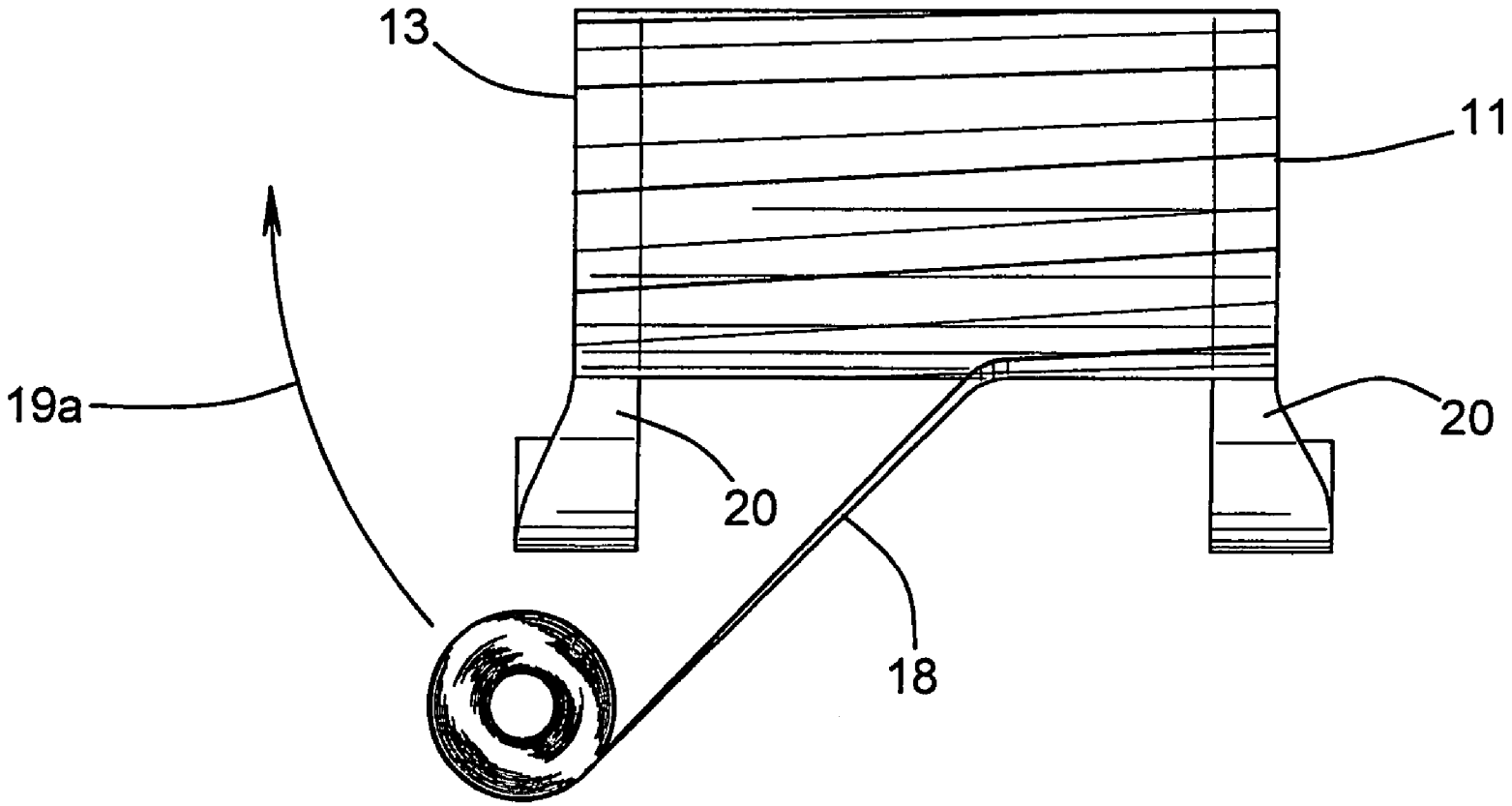
FIG. 9 is a top plan view showing the fourth step of the method illustrated in FIG. 8.

As shown in FIGS. 7 and 8, the protective covering material 18 continues to be wrapped axially about the material roll 10 in the direction of the arrow 19*a* while the material roll 10 is continued to be rotated in the direction of the arrow 19*b*. Such rotation of the material roll 10 not only causes multiple intermediate layers of the protective covering material 18 to be applied in an overlapping manner to the outer surface 16 and end surfaces 11 and 13 of the material roll 10, as described above, but also causes the edge covering materials 20 to be wrapped circumferentially about the circular edge surfaces defined between the outer surface 16 and the spaced end surfaces 11 and 13 of the material roll 10. It can be seen that the edge covering materials 20 are radially interleaved/woven between the initial anchor layer 22 of the protective covering material 18 and the subsequent layers of such protective covering material 18 as they are applied to the material roll 10. Additionally, the axial wrapping of the protective covering material 18 causes the second portions of the edge covering materials 20 to be respectively folded over the associated portions of the end surfaces 11 and 13.

Figure 10:
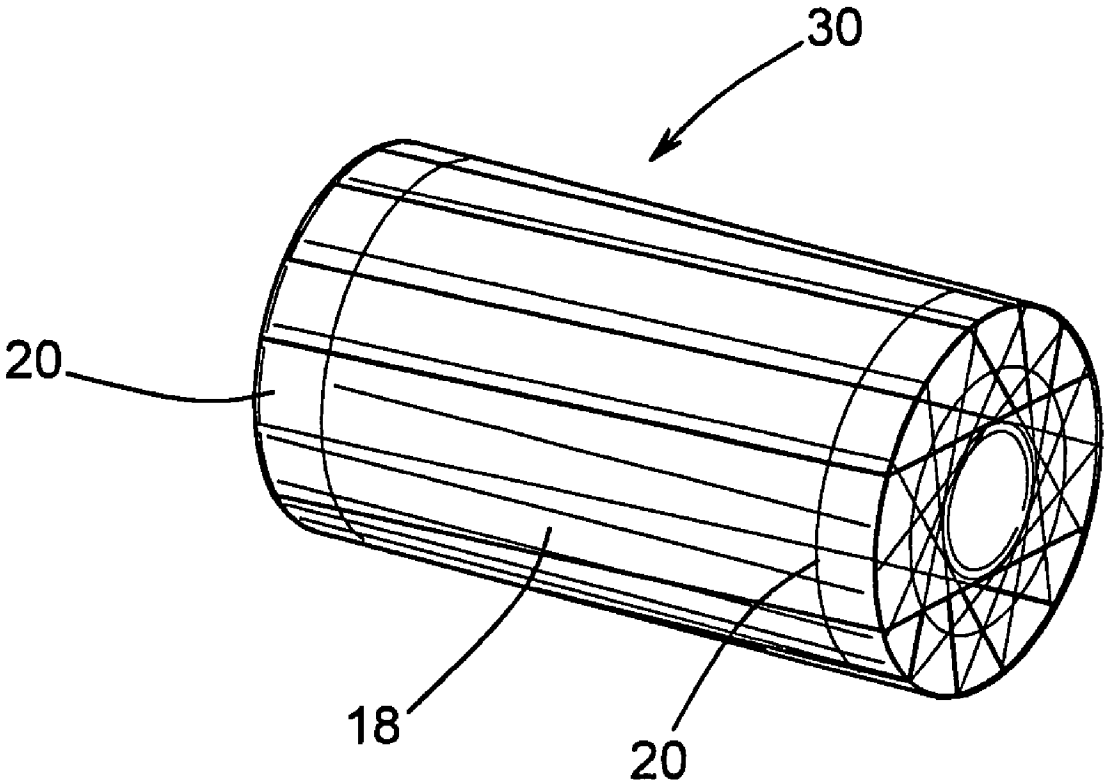
FIG. 10 is a perspective view showing a completed roll package.

The axial wrapping of the protective covering material 18 about the material roll 10 continues while the material roll 10 is rotated about the longitudinal center axis 15 until the outer surface 16 and the end surfaces 11 and 13 of the material roll 10 are completely covered by the protective covering material 18, as shown in FIG. 10, thereby forming a completed roll package, indicated generally at 30. Because the edge covering materials 20 have been radially interleaved/woven with the axially wrapped layers of the protective covering material 18, a radial layer of the edge covering material 20 is also applied to each of the circular edge surfaces defined between the outer surface 16 and the spaced end surfaces 11 and 13 of the material roll 10. The simultaneous application of the edge covering material 20 and the protective covering material 18 provides a particular advantage in that the overall amount of the material that is used is minimized by the combined application of the protective covering material 18 and the edge covering materials 20. By applying the layers simultaneously, the number of affixing and cutting operations are minimized as well. Additionally, removal of the protective covering material 18 and the end covering materials 20 from the roll package 30 is simplified, as the layers of protective covering material 18 and edge covering materials 20 can be simultaneously removed because they are applied to the material roll 10 in a radially interleaved/woven fashion.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A roll package comprising:

a material roll having an outer surface defining an axis and an end surface;

a protective covering material that is axially wrapped about said material roll in a plurality of overlapping layers; and an edge covering material that is circumferentially wrapped about a portion of said outer surface of said material roll and a portion of said end surface of said material roll, said edge covering material being radially woven between said plurality of overlapping layers of said protective covering material.

2. The roll package of claim 1 wherein the amount of overlap between said overlapping layers of protective material is about forty percent.

3. The roll package of claim 1 wherein said overlapping layers of protective material include an anchor layer initially placed over a portion of the outer surface of said material roll.

4. The roll package of claim 3 wherein said edge covering material is secured to said anchor layer prior to being radially woven between said overlapping layers of protective material.

5. The roll package of claim 3 wherein said edge covering material is positioned on said anchor layer such that a portion of said edge covering material extends beyond the outer surface of said material roll.

6. A method of making a roll package comprising the steps of:

(a) providing a material roll having an outer surface defining an axis and an end surface;

(b) axially wrapping a protective covering material about the material roll in a plurality of overlapping layers; and (c) circumferentially wrapping an edge covering material about a portion of the outer surface of the material roll and a portion of the end surface of the material roll such that the edge covering material is radially woven between the plurality of overlapping layers of the protective covering material.

7. The method of claim 6 wherein the amount of overlap between said overlapping layers of protective material formed in step (b) is about forty percent.

8. The method of claim 6 wherein step (c) is accomplished by simultaneously rotating the material roll about its axis as the protective material is axially applied about said material roll.

9. The method of claim 6 wherein said overlapping layers of protective material formed in step (b) include an anchor layer initially placed over a portion of the outer surface of said material roll.

10. The method of claim 9 wherein said edge covering material applied in step (c) is secured to said anchor layer prior to being radially woven between said overlapping layers of protective material.

11. The method of claim 9 wherein said edge covering material applied in step (c) is positioned on said anchor layer such that a portion of said edge covering material extends beyond the outer surface of said material roll.

12. A roll package comprising:

a material roll having an outer surface defining an axis and first and second end surfaces;

a protective covering material that is axially wrapped about said material roll in a plurality of overlapping layers;

a first edge covering material that is circumferentially wrapped about a portion of said outer surface of said material roll and a portion of said first end surface of said material roll, said first edge covering material being radially woven between said plurality of overlapping layers of said protective covering material; and a second edge covering material that is circumferentially wrapped about a portion of said outer surface of said material roll and a portion of said second end surface of said material roll, said second edge covering material being radially woven between said plurality of overlapping layers of said protective covering material.

* * * * *